United States Patent [19]

Pagendarm et al.

[11] Patent Number: 4,764,402

[45] Date of Patent: Aug. 16, 1988

[54] METHOD OF AND APPARATUS FOR APPLYING COATING MATERIAL TO A RUNNING WEB

[75] Inventors: Ralph Pagendarm, Halstenbek; Albert Hebels, Hamburg, both of Fed. Rep. of Germany

[73] Assignee: Pagendarm Beschichtungstechnik GmbH, Hamburg, Fed. Rep. of Germany

[21] Appl. No.: 103,421

[22] Filed: Sep. 30, 1987

[30] Foreign Application Priority Data

Sep. 30, 1986 [DE] Fed. Rep. of Germany ..... 3633106

[51] Int. Cl.[4] ..... B05D 1/28; B05D 3/12; B05C 1/00; B05C 1/14

[52] U.S. Cl. ..... 427/355; 118/65; 118/67; 118/68; 118/106; 118/217; 118/223; 118/257; 427/428; 427/429

[58] Field of Search ..... 118/65, 67, 68, 106, 118/217, 223, 257; 427/355, 428, 429

[56] References Cited

U.S. PATENT DOCUMENTS 4,104,985 8/1978 Klein ..... 118/257 X
4,269,139 5/1981 Adler et al. ..... 118/257 X

*Primary Examiner*—Michael R. Lusignan
*Attorney, Agent, or Firm*—Peter K. Kontler

[57] ABSTRACT

Solvent which is contained in coating material to be applied to a running web is recovered in a chamber which is sealed from the atmosphere and wherein the solvent-containing coating material is first applied to one or more endless belt conveyors which transport the respective layers to discrete transfer stations for application to the running web. Streams of an inert gaseous fluid are circulated through the chamber to withdraw the solvent and to convey it into a condenser wherein the solvent is recovered from the gaseous fluid. The inert gaseous fluid is heated to promote the expulsion of solvent from the coating material on the conveyor or conveyors. The web can be provided with a base coat upstream of the first transfer station so that the layers of coating material are applied over the base coat. The latter is dried upstream of the transfer stations.

20 Claims, 1 Drawing Sheet

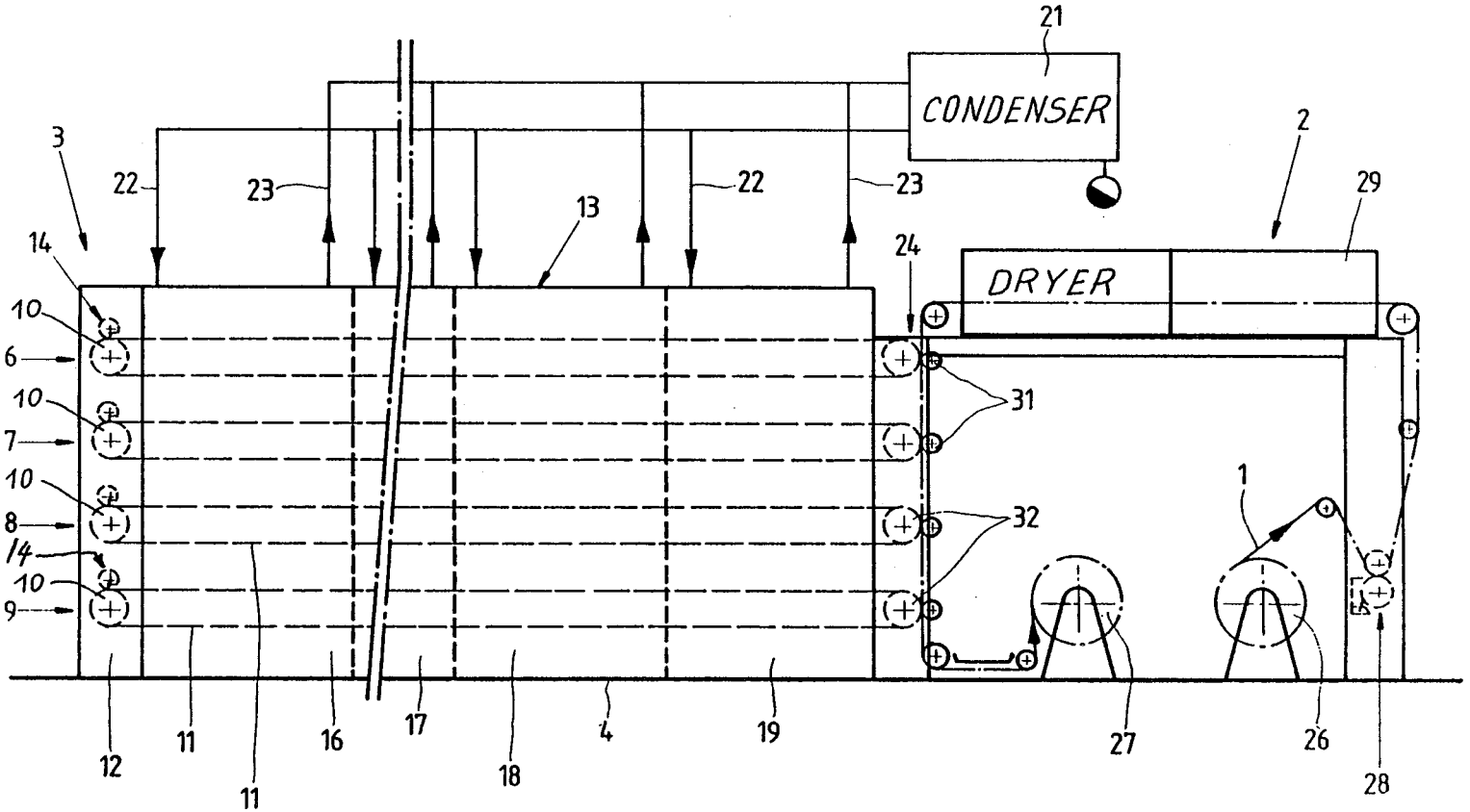
CONDENSER
DRYER
21
29
2
28
26
1
27
31
32
24
23
22
19
4
13
18
17
16
11
11
12
3
14
10
6
10
7
10
8
14
10
9

METHOD OF AND APPARATUS FOR APPLYING COATING MATERIAL TO A RUNNING WEB

BACKGROUND OF THE INVENTION

The invention relates to a method of and to an apparatus for applying one or more layers of coating material (such as an adhesive) to a running web of paper (such as crepe paper), textile material, plastic material or the like. More particularly, the invention relates to improvements in methods of and apparatus for applying to a running web a coating material which contains a solvent, particularly a solvent which warrants or necessitates recovery.

It is already known to convey a web which carries a layer of coating material through a chamber which is sealed from the atmosphere and wherein the coating material is heated to promote the release of solvent so that the latter can be evacuated from the chamber. The chamber is normally filled with an inert gas (i.e., a gas other than air or oxygen), and it is normally necessary to recover the solvent from the inert gas. Such procedure is often resorted to in connection with the making of webs or strips which are coated with a pressure-sensitive or other adhesive, e.g., in connection with the making of adhesive-coated transparent or translucent tape. The inert gas is or can be nitrogen ($N_2$). The purpose of the exclusion of air or oxygen is to render it possible to operate with a high percentage of solvent per unit of volume without the danger of explosion.

A drawback of conventional apparatus which are used to apply solvent-containing coating materials directly to a running web or tape is that losses in inert gaseous fluid are very high unless the chamber is sealed from the atmosphere in a manner which contributes excessively to the cost of the apparatus and of the ultimate product. Inert gases fluid is most likely to escape in regions where the web or tape is introduced into and where the coated web or tape is evacuated from the drying zone of the chamber. As a rule, the application of solvent-containing coating material takes place in a separate zone of the chamber and the thus coated increments of the web are thereupon introduced into the drying zone. The cost of sealing means (especially contact-free sealing means) in the regions where the web or tape enters into and leaves the drying zone of the chamber is very high, especially since it is necessary to separate from the incoming web or tape the (boundary) layer of atmospheric air (either directly from the tape or from the freshly applied solvent-containing layer of coating material) as well as to prevent penetration of atmospheric air into (and hence the escape of inert gaseous fluid from) the drying zone.

Another drawback of conventional coating apparatus is that breaks of the web in the interior of the chamber necessitate an opening of the chamber with attendant huge losses in inert gaseous fluid and prolonged interruptions of the coating operation. As a rule, each opening of the chamber must be preceded by complete evacuation of inert gaseous fluid which entails a lengthy interruption of the coating operation and the aforementioned huge losses in nitrogen or other inert gaseous fluid.

OBJECTS AND SUMMARY OF THE INVENTION

An object of the invention is to provide a novel and improved method which renders it possible to greatly reduce losses in solvent and/or inert gaseous fluid and which also renders it possible to apply to a running web or take one, two or more layers of viscous and/or other adhesive or coloring material in such a way that the web remains accessible at all times.

Another object of the invention is to provide a method which renders it possible to recover a high percentage of solvent and to reuse the inert gaseous fluid as long and as often as desired.

A further object of the invention is to provide a method which is more economical than heretofore known coating methods and which can be utilized for the application of one or more layers of adhesive and/or coloring material in a small area and without the risk of an explosion as a result of combustion of solvent or a mixture of solvent with oxygen.

An additional object of the invention is to provide a method which can be practiced in such a way that one or more layers of coating material can be applied directly to a running web or to a precoated web.

Still another object of the invention is to provide a novel and improved apparatus for the practice of the above outlined method and to construct and assemble the apparatus in such a way that the web which is to be coated is accessible during each and every stage of the coating operation so that a break in or another defect of the web can be attended to without the need to evacuation of inert gaseous fluid and/or other costly and time-consuming undertakings.

A further object of the invention is to provide the apparatus with novel and improved means for expelling and recovering the solvent.

Another object of the invention is to provide a versatile apparatus which can treat the web prior to the application of the first or foremost layer of coating material and which can be set up to apply one, two, three or more layers of coating material in a small area and by resorting to relatively simple, compact and inexpensive components.

One feature of the present invention resides in the provision of a method of coating a first running web (e.g., an elongated tape or strip of textile material, plastic material, paper or the like) by means of a second running web (e.g., by means of an endless belt conveyor). The method comprises the steps of establishing for the first and second webs discrete first and second paths having first portions in which the first and second webs are closely or immediately adjacent each other, advancing the webs in predetermined directions along their respective paths, sealing a second portion of the second path from the surrounding atmosphere upstream of the first portion of the second path, applying a solvent-containing coating material (e.g., a readily flowable or moderately or strongly viscous substance) to successive increments of the second web in the second portion of the second path, at least partially expelling the solvent from the applied coating material in the second portion of the second path, and transferring the at least partially desolventized coating material from the second web onto the first web in the first portions of the first and second paths.

The solvent expelling step can include admitting into the second portion of the second path at least one stream of an inert gaseous fluid (such as $N_2$) which can promote (e.g., as a result of heating) the expulsion of solvent from the coating material, and draining the solvent in inert gaseous fluid from the second portion of the second path. Such method preferably further includes recovering solvent from the withdrawn inert gaseous fluid. The expelling step can further include drying the coating material on the second web, e.g., as a result of contacting the coating material with a heated inert gaseous fluid.

It is often preferred to apply to the first web two or more strata of coating material. The method is then carried out by employing at least one additional running web and comprises the additional steps of establishing for the additional web an additional path which has a first portion adjacent a second portion of the first path and wherein the first and additional webs are preferably closely or immediately adjacent each other, advancing the additional web in a predetermined direction along the additional path, sealing a second portion of the additional path from the surrounding atmosphere upstream of the first portion of the additional path, applying a solvent-containing coating material to successive increments of the additional web in the second portion of the additional path (the coating material which is applied to the additional web may but need not be the same as that which is applied to the second web), expelling at least some of the solvent from the applied coating material in the second portion of the additional path, and transferring the at least partially desolventized coating material from the additional web onto the first web in the first portion of the additional path (i.e., in the second portion of the first path).

The sealing steps can include advancing the second and additional webs through a common chamber which is sealed from the atmosphere. The expelling steps can comprise heating the coating materials in the chamber, e.g., by circulating through the chamber one or more streams of a hot inert gaseous fluid which entrains the solvent to a condenser or to another solvent recovering apparatus.

The method can further comprise the step of applying to the first web a base or primary coat of suitable viscous or other material (which may but need not be the same as those which are applied to the second and additional webs) upstream of the first and second portions of the first path so that the transferred and at least partially desolventized coating material which is supplied by the second and/or additional web overlies the base coat.

Another feature of the invention resides in the provision of an apparatus for coating a first running web (such as the aforementioned strip or tape of paper, textile or plastic (e.g., thermoplastic) material) with at least one layer of coating material (e.g., an adhesive) by means of a second running web. The apparatus comprises means (e.g., a driven takeup reel) for advancing the first web along a first path in a predetermined direction, a housing or casing which constitutes a means for defining a chamber that is sealed from the surrounding atmosphere and has a portion adjacent à first portion of the first path, means for advancing the second web along a second path having a first portion adjacent the first portion of the first path and a second portion disposed upstream of the first portion of the second path and located in the chamber, means for applying a solvent-containing coating material to the second web in the chamber, means for expelling at least some of the solvent from the coating material on the second web in the chamber, and means for transferring the at least partially desolventized coating material from the second web onto the first web in the first portion of the first path. The expelling means can include means for circulating an inert gaseous fluid through the chamber. The latter can be subdivided into a first compartment for the applying means and at least one second compartment for expulsion of solvent from the coating material.

If the apparatus is to apply to the first running web at least one additional layer of coating material, such apparatus comprises at least one additional web, means for advancing the additional web along an additional path having a first portion preferably closely or immediately adjacent a second portion of the first path and a second portion disposed upstream of the first portion of the additional path and located in the chamber, means for applying solvent-containing coating material to the additional web in the second portion of the additional path (i.e., in the chamber), means for at least partially expelling solvent from the coating material on the additional web in the chamber, and means for transferring at least partially desolventized coating material from the additional web onto the first web in the second portion of the first path. The chamber can be a composite chamber having coherent or discrete portions or sections, one for the second web and one for the additional web. For example, the chamber can include several sections including a first section for the second portion of the second path and a second section for the second portion of the additional path. Such sections can be disposed at different levels, particularly one above the other.

The second and/or the additional web can constitute an endless belt conveyor.

The apparatus can further comprise means for applying to the first web a base coat upstream of the first and second portions of the first path so that the transferred at least partially desolventized coating material or materials are applied over the base coat. If the base coat contains moisture which requires expulsion, the apparatus further comprises means for drying the base coat in a third portion of the first path, e.g., upstream of the first and/or second portion of the first path so that the layer or layers of coating material which have been transferred onto the first web overlie a dried base coat.

The expelling means can comprise means for expelling solvent from the coating material on the second and/or additional web in a plurality of successive stages. For example, the expelling means can comprise a condenser, means for conveying the aforementioned inert gaseous fluid from the condenser to several spaced apart portions of the chamber and means for drawing solvent in inert gaseous fluid medium from the spaced-apart portions of the chamber back into the condenser wherein the solvent is recovered from the gaseous fluid.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic elevational view of an apparatus which is designed to apply to a running web first a base coat and thereupon four successive layers of desolventized coating material.

DESCRIPTION OF THE PREFERRED EMBODIMENTS

The drawing shows a web or tape 1 which is stored on the core of a supply reel 26 and is transported along a predetermined path toward and is convoluted onto the core of a driven takeup reel 27. The path is defined by a series of rollers including those shown at 31. The advancing means including the takeup reel 27 causes the web 1 to travel in the direction which is indicated by arrows so that successive increments of the web advance through a first coating unit 2 including a device 28 which applies to one side of the web 1 a base coat of liquid or liquefied (moisture-containing) coating material which is dried during travel through a drying or heating device 29 of the unit 2. The web 1 can constitute the substrate of a finished product in the form of adhesive tape.

The apparatus further comprises a second coating unit 3 defining a chamber 4 which is at least substantially sealed from the surrounding atmosphere. The chamber 4 includes a coating compartment 12 and a drying or heating compartment 13, and this chamber confines the major portions of four webs 11 in the form of endless belt conveyors each trained over a pair of pulleys 10, 32 so that their horizontal or nearly horizontal upper reaches advance in a direction to the right, namely toward a transfer station 24 which is located downstream of the drying and heating device 29 and wherein the right-hand portions of the respective endless paths for the belt conveyors are nearest to spaced-apart portions of the path for the web 1 between the drying or heating device 29 and the takeup reel 27. The right-hand pulleys 32 for the webs or belt conveyors 11 are located outside of the chamber 4. The compartment 13 is subdivided into several (e.g., four) neighboring portions (denoted by the characters 16, 17, 18 and 19) in each of which a solvent expelling device circulates at least one stream of an inert gaseous fluid (such as $N_2$). The solvent expelling device comprises a condenser 21, first conduits 22 which supply inert gaseous fluid from the condenser 21 into the respective portions 16–19 of the compartment 13, and second conduits 23 which return a mixture, dispersion or solution of solvent in inert gaseous fluid into the condenser 21. The latter serves as a means for recovering solvent from the gaseous fluid.

The compartment 12 of the chamber 4 contains four applicators 14, one for each of the belt conveyors 11 and each serving to apply to the respective belt conveyor a layer of solvent-containing coating compound (such as an adhesive) which is to be transferred onto the base coat on the web 1. Each applicator 14 and the device 28 may be constructed in a manner as disclosed in the commonly owned copending patent application Ser. No. 044,813 filed Apr. 30, 1987 for "Method and apparatus for applying flowable materials to running webs of paper and the like". The disclosure of this copending application is incorporated herein by reference.

The chamber 4 comprises four sections 6, 7, 8, 9 each of which accommodates one of the belt conveyors 11 and which are disposed at four different levels, one above the other. The leftmost portion of each such section accommodates the respective applicator 14 and the respective pulley 10. The motor or motors which serve to drive the pulleys 10 and/or 32 for the belt conveyors 11 are not specifically shown in the drawing. The material of the belt conveyors 11 is selected with a view to ensure that these conveyors can retain and transport the layers of solvent-containing coating composition which is applied by the associated applicators 14; at the same time, the belt conveyors 11 exhibit the necessary release characteristics to make sure that each layer of coating material can be readily transferred onto the adjacent portion of the web 1 during travel along those portions of the paths for the belt conveyors 11 which are nearest to the corresponding portions of the path for the web 1.

The coating material which is applied at 14 in the form of thin or very thin layers is or can be a readily flowable material which contains the solvent, and such solvent must be expelled, at least in part, before the respective layer of coating material reaches the transfer station 24 where the pulleys 32 cooperate with the respective rollers 31 to transfer the layers of coating material onto the base coat which has been applied at 28, or onto the previously applied layer or layers.

The inert gaseous fluid which is admitted at 22 is preferably heated to promote the expulsion of solvent from the layers on the upper reaches of the belt conveyors 11. This entails a desirable drying and solidification (and hence a strengthening) of the layers so that the thus solidified layers can be readily advanced through the seals between the rightmost portion 19 of the heating and drying compartment 13 and the transfer station 24 to be applied to the running web 1. The rollers 31 serve as a means for biasing the adjacent portions of the running web 11 toward the respective pulleys 32 so as to promote the transfer of layers of coating material from the respective belt conveyors 11 onto the dried base coat or onto the previously transferred layer or layers. Thus, the lowermost roller 31 in the first coating unit 2 cooperates with the adjacent pulley 32 to transfer the lowermost layer of coating material onto the base coat and three previously applied layers. The coating material which is applied in the section 6, 7, 8 and/or 9 of the chamber 4 may but need not be the same as the other coating material or materials, depending on the intended use of the final product.

The number of belt conveyors 11 (or the number of active belt conveyors) can be reduced to one, two or three or increased to five or more, depending upon the desired thickness and/or other parameters of the composite layer on the web 1.

An important advantage of the improved method and apparatus is that the web 1 (i.e., the carrier of the ultimate layer) need not be confined in the chamber 4, i.e., that such web need not be sealed from the surrounding atmosphere. Therefore, a break in or another defect of the web 1 can be readily attended to without the need for evacuation of inert gaseous fluid from the chamber 4. The method and apparatus of the present invention differ from those disclosed in the commonly owned German Offenlegungsschrift No. 17 52 337 which already proposes to apply to a running web several layers of coating material, one after the other. The purpose of the apparatus which is disclosed in the German publication is to effect a reduction of the overall length of the drying zone. The apparatus of this publication does not fully seal the adhesive layers from the atmosphere, and such apparatus employs a substantial number of discrete chambers for the application of adhesive and for the drying of applied adhesive with all of the aforediscussed problems and drawbacks as concerns the escape of inert gaseous fluid and solvent and penetration of atmospheric air into the regions which are to be filled only with an inert gaseous fluid.

The provision of a common chamber 4 for all of the belt conveyors 11 and applicators 14 contributes to simplicity, compactness and lower cost of the apparatus and hence to lower cost of the ultimate product. The provision of a base coat (at 28) is optional but is desirable in many instances because the material of such base coat can be selected with a view to reliably adhere to the material of the web 1 as well as to the material of the layer which is supplied by the topmost belt conveyor 11.

The subdivision of compartment 13 into two or more portions (16–19) and the subdivision of chamber 4 into sections 6–9 are also optional. The subdivision of compartment 13 into two or more portions each of which can receive at least one discrete stream of inert gaseous fluid is often desirable and advantageous because this allows for a more predictable drying of the layers of coating material as well as for expulsion of a higher percentage of solvent.

The fact that the rightmost portions of the belt conveyors 11 extend from the chamber 4 does not contribute to the escape of a large quantity of inert gaseous fluid and/or to the escape of a large quantity of solvent. The layers of coating material are subjected to an intensive drying and solvent-expelling action during travel toward the respective pulleys 32 so that such layers are capable of withstanding the action of reliable mechanical sealing devices in the right-hand wall of the chamber 4, i.e., the sealing devices can brush back the films of inert gaseous fluid which overlies the solidified and dried layers of coating material and tends to escape into the transfer zone 24. The sealing material around those portions of the belt conveyors 11 which exit and reenter at the right-hand end of the chamber 4 can contain or consist of Teflon (trademark), and the sealing means can assume the form of flexible or rigid lips, blades or the like.

As mentioned above, the entire web 1 is accessible externally of the chamber 4 so that any breaks in and/or other damage to this web can be attented to without the need for evacuation of the expensive inert gaseous fluid from the chamber 4 or from any portion of this chamber. This, too, contributes significantly to a higher output and to lower cost of the apparatus as well as to lower cost of the product.

The temperature in the drying device 29 and in the compartment 13 can be maintained close to but at least slightly below the boiling point of the coating material or materials.

The coating materials can constitute adhesives which can contain medications, for example, if the ultimate product is a band aid or a like product serving to cover wounds, sores and the like. The coating materials can also constitute or contain coloring agents.

The web 1 can constitute a strip of knit fabric (e.g., for the making of band aids), paper or thermoplastic foil.

The belt conveyors 11 can be coated with layers of silicon rubber or a like substance which can be classified as an adhesive-repelling material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of coating a first running web by means of a second running web, comprising the steps of establishing for the first and second webs first and second paths having first portions in which the first and second webs are adjacent each other; advancing the webs along the respective paths; sealing a second portion of the second path from the surrounding atmosphere upstream of the respective first portion; applying a solvent-containing coating material to successive increments of the second web in the second portion of the second path; expelling at least some of the solvent from the applied coating material in the second portion of said second path; and transferring the at least partially desolventized coating material from the second web onto the first web in the first portions of said paths.

2. The method of claim 1, wherein said solvent expelling step includes admitting into the second portion of the second path an inert gaseous fluid which promotes the expulsion of solvent from the coating material, drawing the solvent and gaseous fluid from the second portion of the second path, and recovering solvent from the withdrawn gaseous fluid.

3. The method of claim 1, wherein said expelling step includes drying the coating material on the second web.

4. The method of claim 1 of coating the first running web by means of the second running web and at least one additional running web, comprising the additional steps of establishing for the additional web an additional path having a first portion which is adjacent a second portion of the first path and wherein the first and additional webs are adjacent each other, advancing the additional web along the additional path, sealing a second portion of the additional path from the surrounding atmosphere upstream of the first portion of the additional path, applying a solvent-containing coating material to successive increments of the additional web in the second portion of the additional path, expelling at least some of the solvent from the applied coating material in the second portion of the additional path, and transferring the at least partially desolventized coating material from the additional web onto the first web in the second portion of the first path.

5. The method of claim 4, wherein said sealing steps include advancing the second and additional webs through a common chamber which is sealed from the atmosphere.

6. The method of claim 5, wherein said expelling steps comprise heating the coating material in said chamber.

7. The method of claim 6, wherein said expelling steps further include circulating through the chamber at least one stream of an inert gaseous fluid which entrains the solvent.

8. The method of claim 7, further comprising the step of recovering the solvent from the inert gaseous fluid.

9. The method of claim 1, further comprising the step of applying to the first web a base coat upstream of the first portion of the first path so that the transferred coating material is applied over the base coat.

10. Apparatus for coating a first running web with at least one layer of coating material by means of a second running web, comprising means for advancing the first web along a first path; means defining a chamber which is sealed from the surrounding atmosphere and has a portion adjacent a first portion of said first path; means for advancing the second web along a second path having a first portion adjacent the first portion of the first path and a second portion disposed upstream of the respective first portion and located in said chamber; means for applying solvent-containing coating material to the second web in said chamber; means for expelling at least some of the solvent from the coating material on the second web in said chamber; and means for transferring the at least partly desolventized coating material from the second web onto the first web in said first portions of said paths.

11. The apparatus of claim 10, wherein said expelling means comprises means for circulating an inert gaseous fluid through said chamber.

12. The apparatus of claim 10, wherein said chamber has a first compartment for said applying means and at least one second compartment for expulsion of solvent from the coating material.

13. The apparatus of claim 10 for coating the first running web with the one layer and with at least one additional layer of coating material by means of the second running web and at least one additional running web, further comprising means for advancing the additional web along an additional path having a first portion adjacent a second portion of the first path and a second portion disposed upstream of the respective first portion and located in said chamber, means for applying solvent-containing coating material to the additional web in said chamber, means for expelling at least some solvent from the coating material on the additional web in said chamber, and means for transferring at least partly desolventized coating material from the additional web onto the first web in the second portion of the first path.

14. The apparatus of claim 13, wherein said chamber has several sections including a first section for the second portion of said second path and a second section for the second portion of said additional path.

15. The apparatus of claim 14, wherein said sections are disposed at different levels.

16. The apparatus of claim 10, wherein said second web is an endless belt conveyor.

17. The apparatus of claim 10, further comprising means for applying to the first web a base coat upstream of the first portion of the first path so that the transferred at least partly desolventized coating material is applied over the base coat.

18. The apparatus of claim 17, wherein at least the base coat contains moisture, and further comprising means for drying the base coat in a third portion of said first path.

19. The apparatus of claim 18, wherein the third portion of the first path is located downstream of the first portion of the first path.

20. The apparatus of claim 10, wherein said expelling means includes means for expelling solvent from the coating material on the second web in a plurality of successive stages.

* * * * *